US007964150B2

(12) United States Patent
Balczewski

(10) Patent No.: US 7,964,150 B2
(45) **Date of Patent: *Jun. 21, 2011**

(54) APPARATUS FOR CONTINUOUS PRODUCTION OF HYDRATES

(75) Inventor: John T. Balczewski, Danville, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 714 days.

This patent is subject to a terminal disclaimer.

(21) Appl. No.: 11/554,080

(22) Filed: Oct. 30, 2006

(65) Prior Publication Data

US 2008/0101999 A1 May 1, 2008

(51) Int. Cl.
*B01J 10/00* (2006.01)
*B01J 19/00* (2006.01)
*C07C 9/00* (2006.01)

(52) U.S. Cl. ..... 422/129; 422/228; 422/229; 585/15

(58) Field of Classification Search ..... 422/129, 422/228, 229; 585/15

See application file for complete search history.

(56) References Cited

U.S. PATENT DOCUMENTS

| | | | | |
|---|---|---|---|---|
| 4,744,697 | A | 5/1988 | Coppens | |
| 5,873,262 | A | 2/1999 | Max | |
| 5,950,732 | A | 9/1999 | Agee et al. | |
| 6,035,933 | A * | 3/2000 | Khalil et al. | 166/263 |
| 6,082,118 | A | 7/2000 | Endrizzi | |
| 6,296,060 | B1 | 10/2001 | McCaslin | |
| 6,673,249 | B2 | 1/2004 | Max | |
| 6,682,265 | B1 | 1/2004 | Kudsk | |
| 6,767,471 | B2 | 7/2004 | Max | |
| 6,969,467 | B1 | 11/2005 | Max | |
| 7,246,506 | B2 | 7/2007 | Takao et al. | |
| 2002/0060192 | A1 | 5/2002 | Max | |
| 2002/0129641 | A1 * | 9/2002 | Tucker et al. | 73/49.5 |
| 2003/0178195 | A1 | 9/2003 | Agee et al. | |
| 2004/0143145 | A1 | 7/2004 | Servio et al. | |
| 2005/0016200 | A1 | 1/2005 | Takao et al. | |
| 2005/0247640 | A1 | 11/2005 | Max et al. | |
| 2005/0274258 | A1 | 12/2005 | Spencer | |
| 2008/0101999 | A1 | 5/2008 | Balczewski | |
| 2008/0102000 | A1 * | 5/2008 | Balczewski | 422/129 |
| 2008/0103343 | A1 | 5/2008 | Balczewski | |

FOREIGN PATENT DOCUMENTS

| | | | |
|---|---|---|---|
| JP | 11130700 A | * | 5/1999 |
| JP | 2003055676 A | * | 2/2003 |

OTHER PUBLICATIONS

Machine translation of JP 11130700 A, which was published on May 1999.*

Machine translation of JP 2003055676 A, which was published on Feb. 2003.*

(Continued)

*Primary Examiner* — Walter D Griffin
*Assistant Examiner* — Natasha Young
(74) *Attorney, Agent, or Firm* — Richard J. Schulte

(57) ABSTRACT

A system, process, and apparatus are provided for the efficient continuous production of hydrates. Gas separated from a well fluid is fed into a hydrate reactor that is submerged under the sea at a predetermined depth. The hydrates generated in the hydrate reactor are then transferred to a marine vessel for shipping.

17 Claims, 6 Drawing Sheets

OTHER PUBLICATIONS

Marit Mork, Formation Rate of Natural Gas Hydrate Reactor Experiments and Models, Norwegian University of Science and Technology, Department of Petroleum Engineering and Applied Geophysics, Jul. 2002.*

English translation of JP 11-130700 A, which was published on May 18, 1999.*

English translation of JP 11-130700 A, which was published May 18, 1999.*

English translation of JP 2003-055676 A, which was published Feb. 26, 2003.*

Prabhanjan et al., "Comparison of Heat Transfer Rates Between a Straight Tube Heat Exchanger and a Helically Coiled Heat Exchanger," *International Communications in Heat and Mass Transfer*, 2002, vol. 29, No. 2, pp. 185-191.

International Search Report and Written Opinion for PCT Application No. PCT/US07/82673 mailed Mar. 6, 2008.

International Search Report and Written Opinion for PCT Application No. PCT/US07/82755 mailed Mar. 31, 2008.

International Search Report and Written Opinion for PCT Application No. PCT/US07/82687 mailed Mar. 6, 2008.

* cited by examiner

APPARATUS FOR CONTINUOUS PRODUCTION OF HYDRATES

FIELD OF THE INVENTION

The present invention relates to the efficient continuous production of hydrates. More particularly, the present invention relates to the efficient continuous production of hydrates, also known as methane hydrates, natural gas hydrates, NGH, gas hydrates, gas to solids, GTS clathrates and the like, from offshore oil and gas or natural gas fields utilizing subsea processing equipment.

BACKGROUND OF THE INVENTION

Natural gas is a valuable, environmentally-friendly energy source. With gradually decreasing quantities of clean easily-refined crude oil, natural gas has become accepted as an alternative energy source. Natural gas may be recovered from natural gas reservoirs or as associated gas from a crude oil reservoir. Indeed, natural gas for use in the present process may be recovered from any process which generates light hydrocarbon gases.

In many offshore areas where hydrocarbon resources may be found, there are generally no natural gas pipelines available. As a result, the developer of hydrocarbon resources must either build expensive facilities to re-inject the gas back into the ground, build new pipelines to take the gas to distant markets, or construct expensive liquefied natural gas (LNG), gas to liquids (GTL) or similar facilities to liquefy or re-form the natural gas for transport to distant markets. Flaring of the produced natural gas does not take advantage of the gas as an energy source and is no longer a suitable disposal method for obvious environmental reasons. There is a need for a relatively simple and inexpensive process to produce, store and transport natural gas from offshore fields.

The discovery of clathrates, also known as hydrates, is credited to Humphrey Davey and Michael Faraday, in the early 1800's, Hereinafter, we will use the common word 'hydrate' to mean clathrates, gas hydrates and inclusion compounds. Faraday published a paper on chlorine hydrates in 1823. For almost a century, hydrates remained essentially an intellectual curiosity, Villard, De Forcrand and others in France conducted extensive work on determining what components form hydrates and under what conditions of pressure and temperature. In the 1930's, Hammerschmidt realized that the ice-like blockages that formed at temperatures above 0° C. (32° F.) in the increasingly high pressure natural gas pipelines was due to the formation of hydrates. From that point, scientific attention was focused on the prevention and decomposition of natural gas hydrates. Much of the work was done at the University of Michigan under Professor Katz. In Europe, von Stackelberg was at the same time examining hydrate structures using x-ray diffraction. In 1959 in the Netherlands, Van der Walls and Platteeuw were the first to publish a rigorous thermodynamic model for calculating the conditions at which hydrates form. Research on natural gas hydrates has increased in the last few decades both to understand the geophysical phenomenon of naturally occurring methane hydrates in arctic areas and ocean bottoms as well as the general production storage, transportation and decomposition of natural gas hydrates. Some investigations have also been made into production and decomposition of hydrates as a means to desalinate seawater.

Hydrates are metastable non-stoichiometric crystalline ice-like solids composed largely of hydrogen-bonded lattices (3-dimensional cages) of hydrogen oxide (water) molecules that contain within their cages other small molecules (hydrate formers). The small molecules enter the lattice and stabilize it. The water molecules are referred to as the "host" molecules and the other molecules are "guest" molecules or 'hydrate formers'. An interesting aspect of the hydrates is that there is typically no bonding between the guest and host molecules. The guest molecules can freely rotate inside the host cages.

Gas hydrates usually form one of three basic crystal structures known as Structure-I, Structure-II and Structure-H. These structures are able to host guest molecules with molecular diameters ranging between 2.2 and 7.1 angstroms. More specifically, guest molecules can be methane, ethane, propane, isobutane, carbon dioxide, hydrogen sulfide, nitrogen, chlorine, 2-methylbutane, methylcyclopentane, methylcyclohexane, cyclooctane and the like, and mixtures thereof. Normal butane is a special case. Although pure normal butane will not by itself form a hydrate, it can form hydrates in mixtures with other guest molecules.

Hydrates form when a sufficient amount of water and hydrate former are present under the right combination of temperature and pressure, which can include temperatures above the freezing point of water 0° C. (32° F.). One cubic meter of methane hydrate can contain, for example, 171.5, standard cubic meters of methane at near-atmospheric pressure. Hydrates are stable at high pressures (usually but not always greater than atmospheric pressure) and are poor conductors of heat.

Below, Table 1 illustrates experimental data for natural gas component quadruple points (Q1, Q2) used in a hydrate phase diagram. From such a phase diagram, the right combination of temperature and pressure for hydrate formation can be determined. Note that these quadruple points may vary depending on gas concentration/combination, water purity, etc.

TABLE 1

| Component | T(K), P(MPa) at Q1 | T(K), P(MPa) at Q2 |
|---|---|---|
| Methane | 272.9, 2.563 | No Q2 |
| Ethane | 273.1, 0.530 | 287.8, 3.39 |
| Propane | 273.1, 0.172 | 278.8, 0.556 |
| Iso-Butane | 273.1, 0.113 | 275.0, 0.167 |
| Carbon Dioxide | 273.1, 1.256 | 283.0, 4.499 |
| Nitrogen | 271.9, 14.338 | No Q2 |
| Hydrogen Sulfide | 272.8, 0.093 | 302.7, 2.239 |

Hydrate technology is being developed for production, storage and transportation of natural gas, particularly for remote fields with associated or non-associated natural gas. Hydrate technology may be competitive with liquefied natural gas and other natural gas technologies as a means to commercialize natural gas resources.

Several barriers to commercially viable hydrate production exist, including: the need for large amounts of fresh water; the slow formation rate of hydrates unless significant amounts of turbulence or agitation are present; the high pressures required; and, the high latent heat of formation which requires significant amounts of heat to be removed during the process. The formation of hydrates in a quiescent system is extremely slow at hydrate forming temperatures and pressures. Attempts to improve hydrate production include "rocking" the apparatus, or by mechanical stirring of the contents. As a consequence, many of these processes are necessarily of a batch nature. Another partial deficiency of hydrate production is that free water (not bound by the hydrates) remains between the hydrate particles in the interstitial spaces. Even an apparently solid hydrate mass can contain large amounts of free water. It is possible for more free water to be present in hydrates than bound water. This leads to storage and transportation inefficiencies.

SUMMARY OF THE INVENTION

The present invention achieves the advantage of an apparatus for continuous production of high quality hydrates.

In an aspect of the invention, an apparatus for continuous production of hydrates includes: a hydrate reactor having a top end and a bottom end, a gas injection port positioned near the bottom end, a seawater port positioned near the bottom end; and a transfer hose connected to the top end of the hydrate reactor.

Optionally, the above apparatus further includes an insulating member for covering an upper portion of the top end.

Optionally, the above apparatus further includes a free water recycle port positioned near the bottom of the hydrate reactor.

Optionally, in the above apparatus, the hydrate reactor includes a tubular portion.

Optionally, in the above apparatus, the hydrate reactor includes a conical portion.

Optionally, the above apparatus further includes a separator connected to the gas injection port.

Optionally, the above apparatus further includes a compressor connected to the gas injection port.

Optionally, the above apparatus further includes a helical vane attached to the inside surface of the hydrate reactor.

Optionally, the above apparatus further includes a vane attached to the outside surface of the hydrate, reactor.

Optionally, in the above apparatus, the hydrate reactor is installed adjacent to a drilling platform leg and supported by existing pile guides.

Optionally, in the above apparatus the length of the hydrate reactor is at least about 250 m.

Optionally, in the above apparatus, the length of the hydrate reactor is at least about 700 m.

Optionally, in the above apparatus, the seawater port is positioned below the gas injection port.

Optionally, in the above apparatus, the seawater port is positioned above the gas injection port.

DETAILED DESCRIPTION OF THE INVENTION

Figure 1:
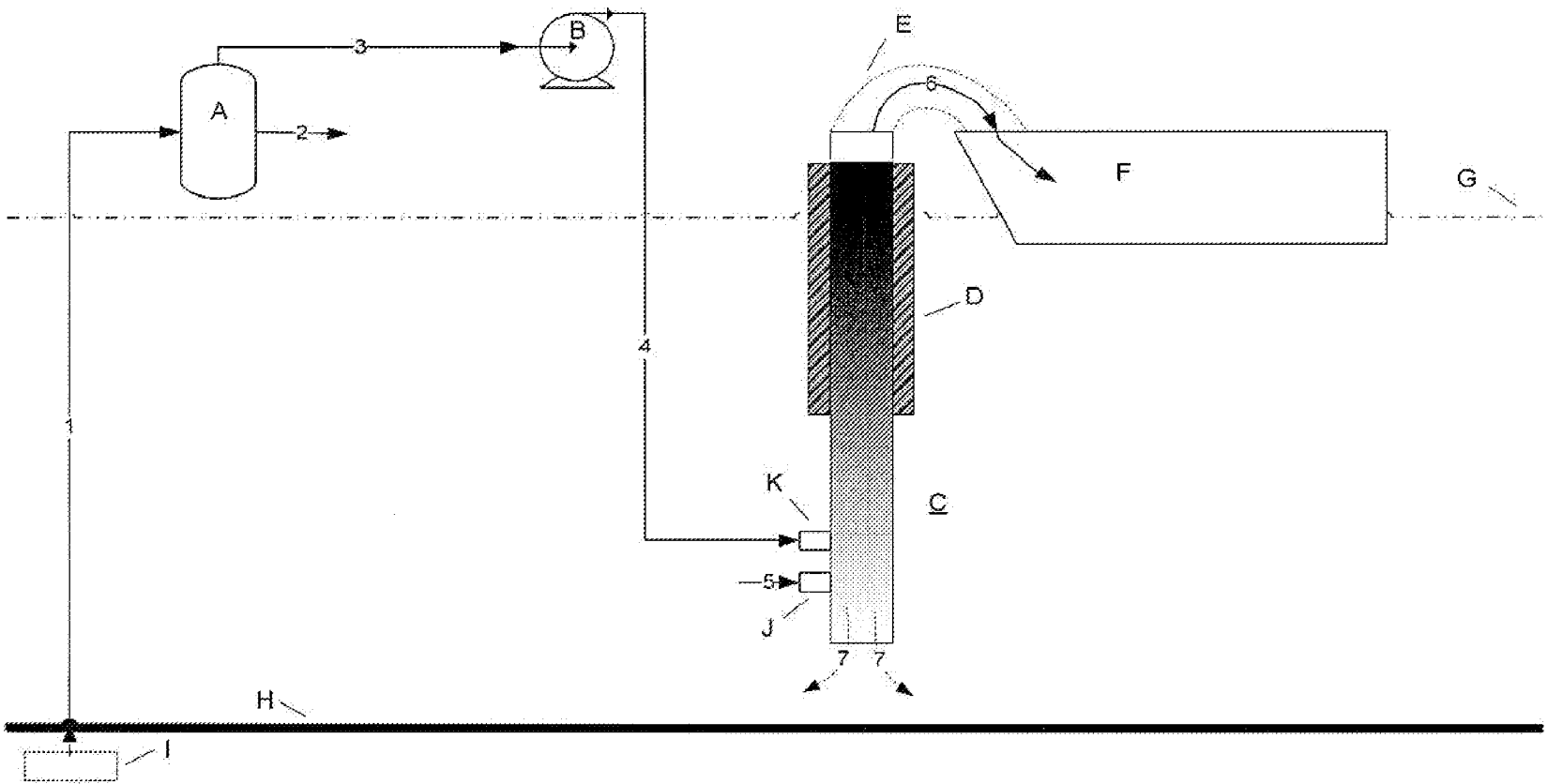
FIG. 1 illustrates an embodiment of the invention showing a system, process and apparatus for the continuous production of hydrates.
Figure 2A:
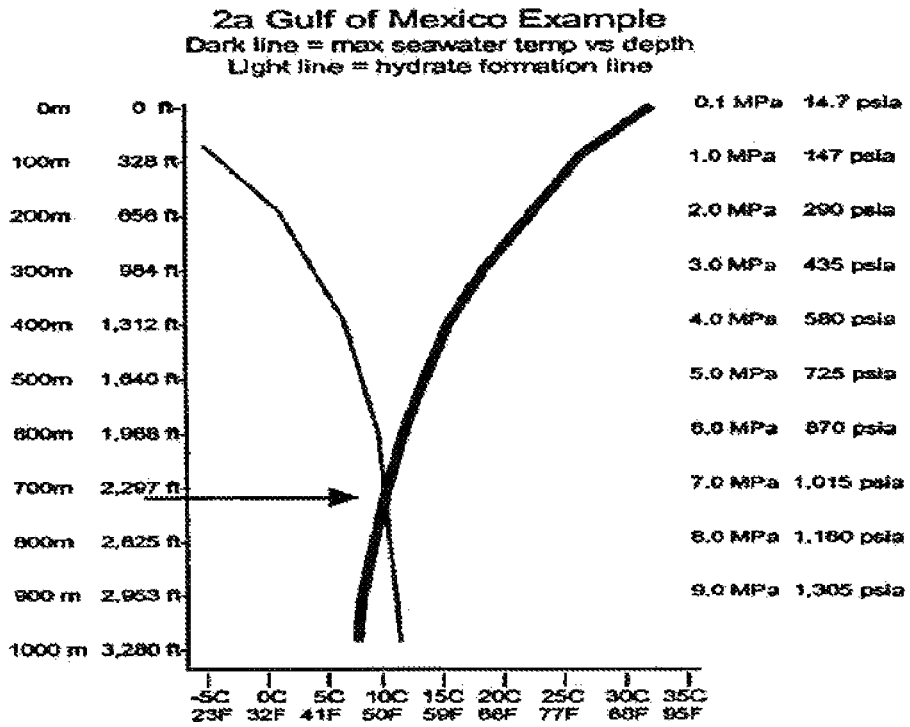
FIG. 2(*a*)-(*c*) are graphs showing seawater temperature and pressure as a function of depth for a number of offshore locations worldwide. A phase diagram of natural gas hydrate is superimposed on each to illustrate possible depth requirements for the bottom of the hydrate reactor shown in FIG. 1.
Figure 2B:
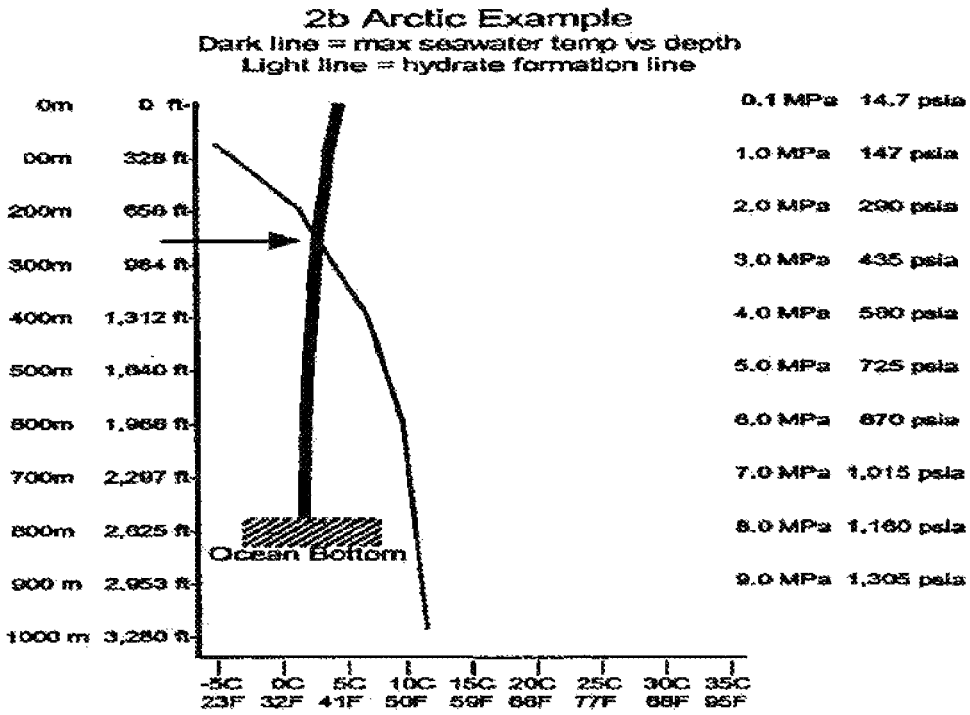
Figure 2C:
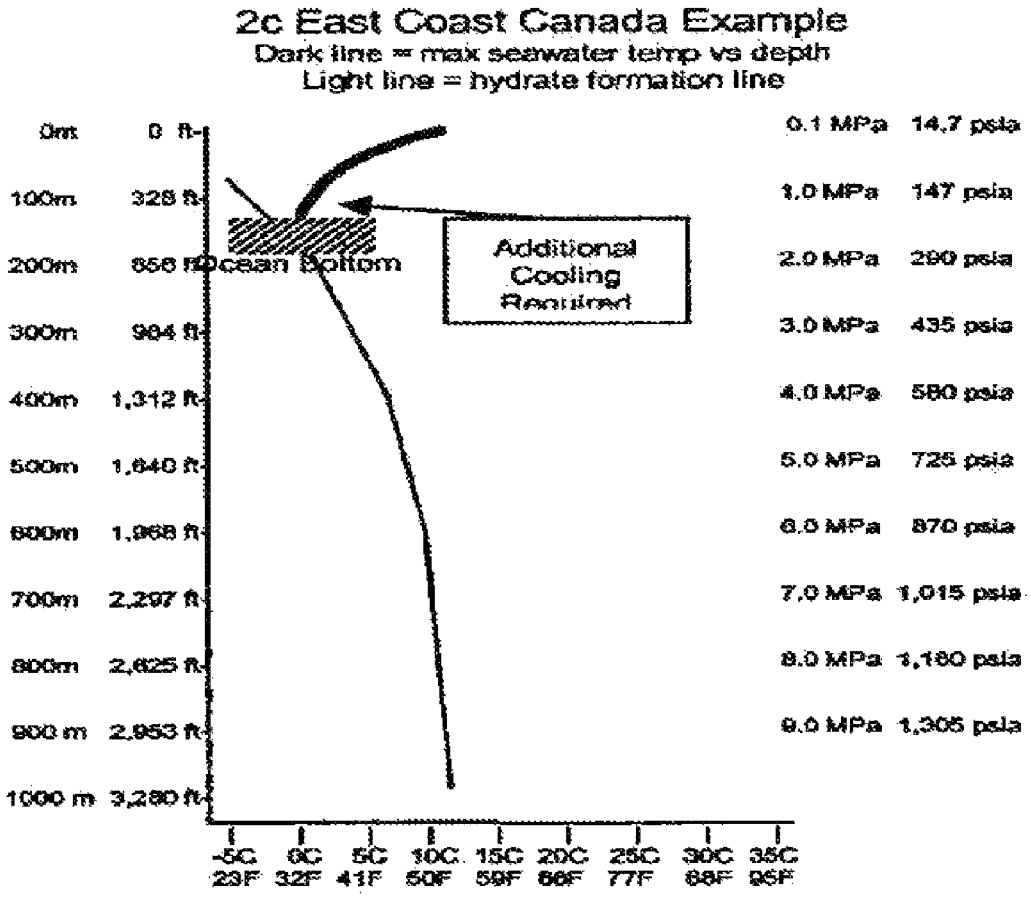
Figure 3:
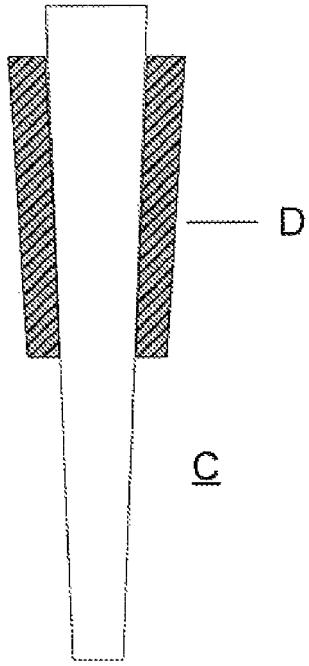
FIG. 3 illustrates a conical hydrate reaction.

Embodiments of the system, process and apparatus of this invention are referenced in FIGS. 1 to 6. In FIG. 1, well fluids (1) are transported in a normal fashion from a reservoir (I) below a sea floor (H) to a sea surface (G) for processing. Processing in a normal manner may include separation of well fluids (1) into natural gas, such as methane, ethane, propane and butane, and liquid hydrocarbons in a separator (A). Separated liquids (2) such as oil and water are further processed and are not in the scope of this invention. Natural gas (3) exits the separator (A) under pressure and at a high temperature relative to cold seawater. Depending on the system requirements, the gas pressure at the exit of the separator (A) may be further boosted using a gas compressor (B).

Compressed gas (4) is then routed below the sea surface (G) and introduced into the bottom portion of a hydrate reactor (C) via a compressed gas injection port (K). There is a small pressure difference between the inside and the outside of the hydrate reactor (C), primarily due to density difference between inner fluids/hydrates/outer seawater at a given depth. Because of this small pressure differential (<100 psi) a thin-walled pipe or tube can be used. The minimum pressure in the gas injection port (K) needs to be sufficient to overcome the hydrostatic head pressure at a given depth.

En route to the compressed gas injection port (K), heat is naturally removed from the compressed gas (4) in the compressed gas injection pipe by the surrounding cool seawater. Increasing amounts of heat are removed with increasing depth. Heat removal from the compressed gas (4) aids in formation of hydrates later on in the process by precooling the gas. Overpressure of the compressed gas (4) beyond hydrostatic minimums may be of advantage in facilitating hydrate formation by temperature drop (Joule-Thompson effect) and additional turbulence as the compressed gas (4) exits the compressed gas injection port (K).

As the compressed gas (4) vigorously enters the hydrate reactor (C) near the bottom, the gas forms into bubbles, preferably small diameter (less than about 2.5 mm), which automatically rise. As the bubbles rise they mix with seawater in the hydrate reactor (C). The combined gas bubbles and seawater mixture has less density than the surrounding seawater, causing the combined mixture to rise inside the hydrate reactor (C). This creates a suction force at the bottom of the hydrate reactor (C), pulling additional seawater (5) into the hydrate reactor (C) via a seawater port (J). As illustrated in FIG. 1, the seawater port (J) is preferably positioned below the gas injection port (K). Alternatively, the seawater port (J) could be positioned above the gas injection port (K).

Due to the high pressure and low temperature of deeper water, an environment exists at the bottom of the hydrate reactor (C) that is conducive to the formation of hydrates. The depth of the bottom of the hydrate reactor (C) can be determined, for example, by using a phase diagram of natural gas hydrate superimposed on a diagram showing seawater temperature and pressure as a function of depth (See FIGS. 2A-2C).

For example, in one specific location in the Gulf of Mexico, hydrates can form at pressures at depths greater than about 700 m where temperatures are typically less than about 10° C. Thus, the length of the hydrate reactor (C) at this location needs to be at least about 700 m long in these conditions. However, in one specific location in the arctic ocean, hydrates can form at pressures at depths greater than about 300 m where temperatures are typically less than about 3° C. Thus, the length of the hydrate reactor (C) at this location should be at least about 300 m.

Fresh water ($H_2O$) molecules are physically pulled out of the seawater forming host lattices around the surface of each gas bubble. Guest molecules from within each bubble become trapped in the resultant cages, with host and guest molecules forming hydrate crystals. The reaction is greatly facilitated by the turbulence of the compressed gas (4) as it exits the compressed gas injection port (K) as well as the turbulent rise of the gas bubbles.

Heat from the hydrate formation is conducted through the walls of the hydrate reactor (C) and is removed by the cool water surrounding the hydrate reactor (C).

As the mixture rises, the gas bubbles expand due to the decreasing hydrostatic pressure. This expansion causes a continuous shattering of newly formed hydrate on the gas bubble surfaces, resulting in further mixing of water and gas bubbles that enhances the formation of additional hydrates while simultaneously prevents existing hydrates from consolidating. Brine (7) and any marine organisms precipitate out the bottom of the hydrate reactor (C) due to their higher density than the hydrate/gas bubble/fresh water mixture.

At an appropriate region, the hydrate reactor can be provided with insulation (D) in order to prevent heat ingress from warmer waters near the ocean surface (G), which would tend to decompose the hydrates at especially low production rates. At high production rates, ice will form on the outer surface of the hydrate reactor (C) and insulation may not be required.

At the top of the hydrate reactor (C), a water/hydrate slurry (6) is directed into a storage tank of a marine vessel (F) via a transfer hose (E). Since the hydrates have such a low density as compared to the seawater, they rise in the hydrate reactor (C) at a high velocity, which can be as high as about 2-4 m/s. Due to the high velocity rise of the hydrates, the water/hydrate slur (6) is ejected out the top of the hydrate reactor (C) into the marine vessel (F) via the transfer hose (E).

Other Embodiments

Other embodiments of the present invention include the following:

In order to enhance hydrate formation in the hydrate reactor (C), free water can be separated from the hydrate slurry (6) output from the top of the hydrate reactor (C) with a screen (L) and recycled back to a water recycle port (M) at the bottom of the hydrate reactor (C) via a free water recycle line (8). Also, free water in the marine vessel (F) ma be directed to the water recycle port (M) via another screen (L) and another free water recycle line, or combined with the previously described free water recycle line (8).

The hydrate reactor (C) can be shaped slightly conical such that the narrow end is at the bottom of the hydrate reactor (C) and the wide end is at the top of the hydrate reactor (C). The wide end at the top of the hydrate reactor (C) aids in preventing the hydrates from clogging the hydrate reactor (C) (See FIG. 3).

Figure 4:
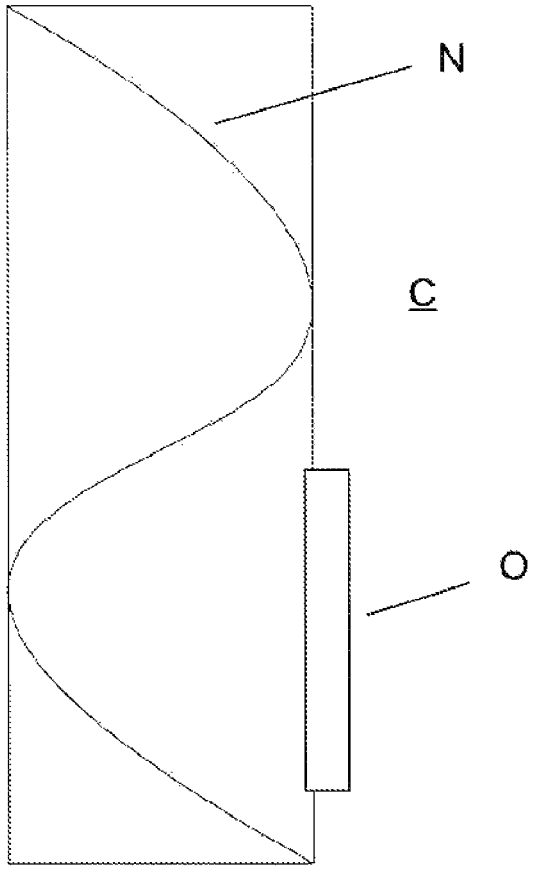
FIG. 4 illustrates a hydrate reactor having vanes.

In order to enhance hydrate formation inside the hydrate reactor, vanes (N) or other protrusions can be attached to the inside surface of the hydrate reactor (C) to provide additional mixing effect, facilitate heat transfer, and to channel brine/sea organisms out. As illustrated in FIG. 4, the vanes (N) are helical vanes providing a spiral path upward through the hydrate reactor (C). Further, vanes (O) may be provided on the outside surface of the hydrate reactor (C) for a better cooling effect.

Figure 5:
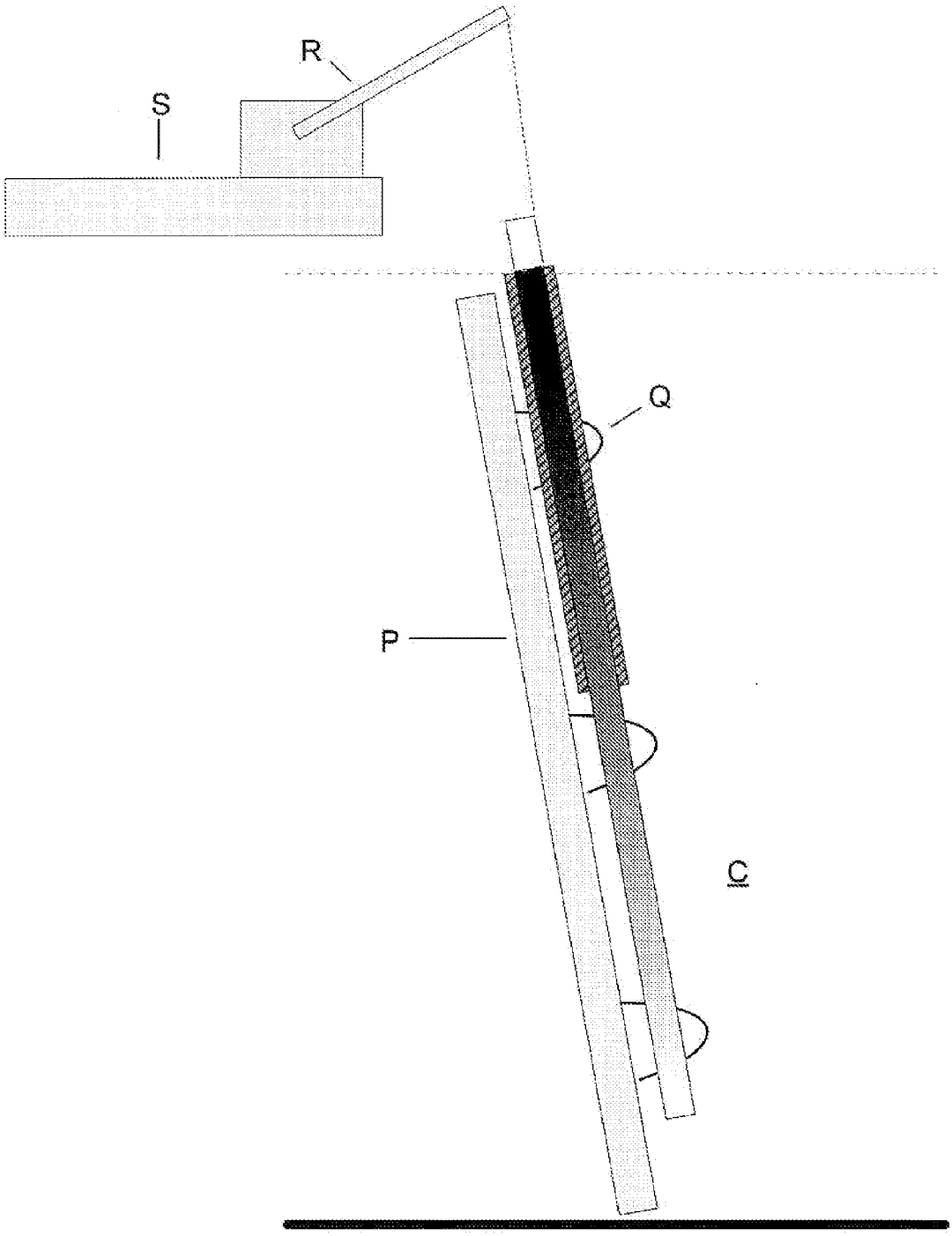
FIG. 5 illustrates a hydrate reactor being installed adjacent to a platform leg of a drilling platform.
Figure 6:
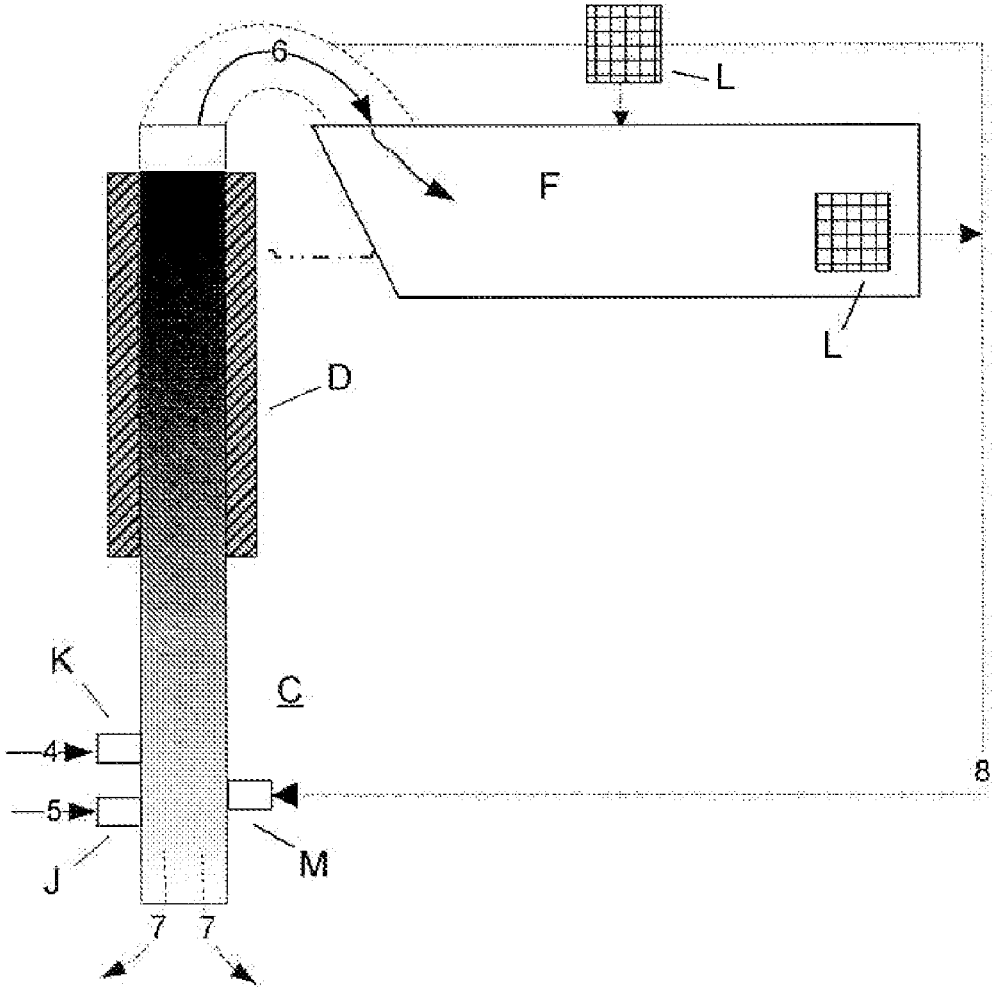
FIG. 6 illustrates a hydrate reactor being used in combination with free water recycle lines.

Also, as illustrated in FIG. 5, the hydrate reactor (C) can be installed and adjacent to an existing platform leg (P) by utilizing existing pile guides (Q) to attach and support the hydrate reactor (C) on a platform leg. A crane (R) on a drilling platform (S) can be used to suspend and position the hydrate reactor (C) at a desired depth though the pile guides (Q) for installation and maintenance. The crane (R) may also be used to adjust the water depth of the hydrate reactor (C) as needed. The hydrate reactor (C) can be moored and operated in a vertical orientation or at an angle relative to vertical such as illustrated in FIG. 5 where there is an angle between the long axis of the hydrate reactor (C) and vertical.

The process of the present invention includes the steps of introducing a natural gas into the hydrate reactor at least partially submerged in water, allowing the natural gas to mix with water inside the hydrate reactor at a pressure and temperature suitable for generating hydrates, forming hydrates as the natural gas and water flows upward through the hydrate reactor, and recovering the hydrates from the hydrate reactor.

In the step of introducing the natural gas into the submerged hydrate reactor (C), the compressed gas (4) is routed below the sea surface (G) and introduced into the bottom portion of the hydrate reactor (C) via the compressed bias injection port (K).

In the step of allowing the natural gas to mix with water inside the hydrate reactor, the compressed gas (4) is allowed to vigorously enter the hydrate reactor (C) and form gas bubbles. As the bubbles rise, they mix with seawater in the hydrate reactor (C).

In the step of forming hydrates, fresh water ($H_2O$) molecules are physically pulled out of the seawater forming host lattices around the surface of each gas bubble. Guest molecules from within each bubble become trapped in the resultant cages, with host and guest molecules forming hydrate crystals.

In the step of recovering the hydrates, the hydrates are directed into a storage tank of the marine vessel (F) via the transfer hose (E). Due to the high velocity rise of the hydrates, the water/hydrate slurry (6) is ejected out the top of the hydrate reactor (C).

The process of the invention includes the following additional steps of cooling the natural gas before introducing the natural gas into the reactor, separating free water from the hydrates recovered from the hydrate reactor and recycling the separated free water back to the hydrate reactor, separating a well fluid from a reservoir into a liquid and the natural as prior to introducing the natural gas into the hydrate reactor, compressing the natural gas prior to introducing the natural gas into the hydrate reactor, cooling the natural gas and water as hydrates are forming by directing the natural gas and water against a heat exchange surface within the hydrate reactor, and cooling the hydrate reactor by conducting heat to vanes on the outside surface of the hydrate reactor.

In the step of cooling the natural gas before introducing the natural gas into the reactor, heat is naturally removed from the compressed gas (4) in the compressed gas injection pipe by the surrounding cool seawater.

In the step of separating and recycling free water, free water is separated from the hydrate slurry (6) output from the top of the hydrate reactor (C) with the screen (L) and recycled back to the water recycle port (M) via the free water recycle line (8).

In the step of separating a well fluid, well fluids (1) from the reservoir (I) are directed to the separator (A) and separated into the natural gas (3) and the liquids (2).

In the step of compressing the natural gas, the gas pressure at the exit of the separator (A) is further boosted using the gas compressor (B).

In the step of cooling the natural gas and water the natural gas and water is directed across vanes (N) or other protrusions that facilitate heat transfer. The vanes (N) may be helical vanes providing a spiral path upward through the hydrate reactor (C).

In the step of cooling the hydrate reactor (C), heat is transferred through the vanes (O) provided on the outside surface of the hydrate reactor (C).

What is claimed is:

1. An apparatus for continuous production of hydrates, comprising:

a hydrate reactor having a top end portion and a bottom end portion and a body portion extending there between with the body portion increasing in cross-section from the bottom end portion to the top end portion, a gas injection port positioned near the bottom end portion, and a seawater port positioned near the bottom end portion and a discharge opening formed in the top end portion;

wherein when the hydrate reactor is vertically aligned at least partially in a body of water, hydrates can be formed in and can move upwardly in the hydrate reactor under hydrostatic pressure with the body portion increasing in cross-section aiding in preventing the hydrates from clogging the hydrate reactor.

2. The apparatus according to claim 1, further comprising an insulating member for covering an upper portion of the top end portion.

3. The apparatus according to claim 1 or 2, further comprising a free water recycle port positioned near the bottom portion of the hydrate reactor.

4. The apparatus according to claim 1, wherein the body portion of the hydrate reactor comprises a tubular portion.

5. The apparatus according to claim 1, wherein the body portion of the hydrate reactor comprises a conical portion.

6. The apparatus according to claim 1, further comprising a transfer hose in fluid communication with the discharge port and connected to the top end portion of the hydrate reactor.

7. The apparatus according to claim 1, further comprising a compressor connected to the gas injection port.

8. The apparatus according to claim 1, further comprising a helical vane attached to an inside surface of the hydrate reactor.

9. The apparatus according to claim 1, wherein the length of the hydrate reactor is at least about 300 m.

10. The apparatus according to claim 1, wherein the length of the hydrate reactor is at least about 700 m.

11. The apparatus according to claim 1, wherein the seawater port is positioned below the gas injection port.

12. The apparatus according to claim 1, wherein the seawater port is positioned above the gas injection port.

13. An apparatus for continuous production of hydrates, comprising:

a hydrate reactor having a top end portion and a bottom end portion and a body portion extending there between and a discharge opening formed in the top end portion, a gas injection port positioned near the bottom end portion, a seawater port positioned near the bottom end portion and a helical vane disposed within the body portion to provide a spiral path upward through the hydrate reactor;

wherein the hydrate reactor comprises a conical portion with the hydrate reactor generally increasing in cross-section from the bottom end portion towards the upper end portion to prevent the hydrates from clogging the hydrate reactor when hydrates are formed in the hydrate reactor; and wherein when the hydrate reactor is vertically aligned and at least partially submerged in sea water, hydrates formed in the hydrate reactor will follow the spiral path and channel heavier contaminants outwardly.

14. The apparatus according to claim 13, further comprising a transfer hose in fluid communication with the discharge port and connected to the top end portion of the hydrate reactor.

15. The apparatus according to claim 13, wherein the length of the hydrate reactor is at least about 700 m.

16. The apparatus according to claim 13, wherein the seawater port is positioned below the gas injection port.

17. The apparatus according to claim 13, wherein the seawater port is positioned above the gas injection port.

* * * * *